US006557509B1

(12) United States Patent
Hall et al.

(10) Patent No.: US 6,557,509 B1
(45) Date of Patent: May 6, 2003

(54) ELECTRICAL SYSTEM FOR AN OUTBOARD MOTOR HAVING AN ENGINE WITH A MANUAL RECOIL STARTER

(75) Inventors: Ronald L. Hall, Fond du Lac, WI (US); Richard L. Sleder, Sr., Fond du Lac, WI (US); David L. Neumann, Plymouth, WI (US)

(73) Assignee: Brunswick Corporation, Lake Forest, IL (US)

( * ) Notice: Subject to any disclaimer, the term of this patent is extended or adjusted under 35 U.S.C. 154(b) by 31 days.

(21) Appl. No.: 09/949,447

(22) Filed: Sep. 7, 2001

(51) Int. Cl.[7] ..... F02D 45/00; F02N 15/00
(52) U.S. Cl. ..... 123/179.16; 440/85
(58) Field of Search ..... 123/179.16, 179.17, 123/472, 475, 476, 490, 491, 179.24; 440/84, 85

(56) References Cited

U.S. PATENT DOCUMENTS 4,157,083 A 6/1979 Smith et al. ..... 123/179
5,216,994 A * 6/1993 Aoki et al. ..... 123/490
5,479,909 A * 1/1996 Blakeslee et al. ..... 123/491
5,482,022 A * 1/1996 Aoki et al. ..... 123/479
5,681,193 A 10/1997 Pham et al. ..... 440/1
5,816,221 A * 10/1998 Krueger ..... 123/491
5,937,829 A 8/1999 Endou ..... 123/497
5,975,058 A * 11/1999 French et al. ..... 123/490
5,988,130 A 11/1999 Nakamura ..... 123/179
5,988,132 A 11/1999 Watanabe ..... 123/185
6,087,735 A 7/2000 Nakamura ..... 307/9.1
6,505,595 B1 * 1/2003 Koerner ..... 123/179.5

* cited by examiner

*Primary Examiner*—Henry C. Yuen
*Assistant Examiner*—Arnold Castro
(74) *Attorney, Agent, or Firm*—William D. Lanyi

(57) ABSTRACT

An outboard motor with a manual recoil starter is provided with an electrical system that is manually actuated and provides the required electrical power to an electrical load associated with a fuel pump, fuel injectors, and ignition coils of the engine. When the operator pulls the rope of the manual recoil starter, the required electrical power for the fuel pump, ignition coils, and fuel injectors is provided by a small compact battery pack. When fully charged, the battery capacity is equal to or less than 12 ampere-hours and is sufficient to power the ignition and fuel system, but typically not sufficient to power a starter motor.

20 Claims, 3 Drawing Sheets

ELECTRICAL SYSTEM FOR AN OUTBOARD MOTOR HAVING AN ENGINE WITH A MANUAL RECOIL STARTER

BACKGROUND OF THE INVENTION

1. Field of the Invention

The present invention is generally related to an outboard motor electrical system and, more particularly, to an electrical system for an outboard motor which is equipped with a manual recoil starter.

2. Description of the Prior Art

Many different types of outboard motors are known to those skilled in the art. Some outboard motors are manually started through the use of a manual recoil starter. As is well known to those skilled in the art, manual recoil starters typically comprise a pull-rope which is used to manually initiate the rotation of the crankshaft of the engine. This, in turn, provides sufficient rotation of the crankshaft for the engine to begin operating in a self sustaining mode.

U.S. Pat. No. 5,988,132, which issued to Watanabe on Nov. 23, 1999, describes a pull starter for an outboard motor. The pull starter for an engine powering an outboard motor and having a cowling and a water propulsion device is disclosed. The engine is positioned in the cowling and has a generally vertically extending crankshaft. A lower end of the crankshaft is arranged to drive the water propulsion device. The starter includes a drum connected to the crankshaft at a top end of the engine, a starter cord having a first end connected to the drum and a second end connected to a handle, and a cord guide for guiding the cord through the cowling, the cord guide including an arcuate cord-engaging surface. The cord extends through the cowling in a first direction and is then guided by the arcuate surface of the cord guide into a second direction to the drum.

U.S. Pat. No. 5,988,130, which issued to Nakamura on Nov. 23, 1999, describes an electrical system for an outboard engine. The system is an electrical system for an engine of the type used to power a watercraft. A primary power supply of the system is connected to a main circuit by a feed circuit. A main switch controls the flow of power from the primary power supply to the main circuit through the feed circuit. An auxiliary power supply is connected to the main circuit in a manner which allows power to flow from the auxiliary power supply to the main circuit even if the main switch is preventing power to flow from the primary power supply to the main circuit.

U.S. Pat. No. 4,157,083, which issued to Smith et al on Jun. 5, 1979, describes a combination manual and power starter for engines. The device is a starter mechanism for an engine having a starter gear which includes a rotatable starter shaft. It includes a starter pinion rotatably mounted on the starter shaft for axial movement in response to rotation of the starter shaft in one direction to an engine starting position in driving engagement with the engine starter gear. It also includes a drive member mounted for rotation coaxially with the starter shaft and drivingly connected to the starter shaft. Manual starting of the engine is selectively effected by rotating a circular member or rotor drivingly connected to the drive member through a first one-way clutch which, in response to rotation of the rotor in the one direction, affords common rotary movement of the rotor and the drive member and permits free wheeling of the drive member relative to the rotor in the same direction when the rotor is not operated. Powered starting of the engine is selectively effected, independently of the manual starter, by a power unit including a driven gear mounted coaxially with the drive member and drivingly connected to the drive member through a second one-way clutch which, in response to operation of the power unit, affords common rotary movement of the drive gear and the drive member in the one direction and which permits free wheeling of the drive member relative to the driven gear in the same direction when the power unit is not operated.

U.S. Pat. No. 6,087,735, which issued to Nakumura on Jul. 11, 2000, describes a power circuit for marine engine. One embodiment of an engine has an electrical system generally comprising a charge circuit and an ignition circuit. A primary power supply circuit connects the charge circuit and the ignition circuit through a non-contact switch circuit. The non-contact switch is adapted to connect the primary power supply circuit to the ignition circuit when the engine is started. A secondary power supply circuit is coupled to at least one electrical component and to the ignition circuit. The secondary power supply circuit has a main switch and a fuse arranged upstream of the main switch. Upon closing the main switch, the engine is started and the primary power supply circuit and the associated non-contact switch are closed. Another embodiment of the engine has an electrical system which adds control of a fuel injector circuit. The fuel injector is in electrical communication with the ignition circuit and a switching circuit which controls the ignition circuit and the fuel injector circuit.

U.S. Pat. No. 5,937,829, which issued to Endou on Aug. 17, 1999, describes a fuel pump drive apparatus for fuel injection equipment for an internal combustion engine. A fuel pump drive apparatus for a fuel injection equipment for an internal combustion engine is capable of satisfactorily driving a fuel pump for a fuel injection equipment without being affected by a variation in a voltage across a battery. A magneto driven by the internal combustion engine is provided with a battery charging coil and a pump drive coil. An output of the pump drive coil is fed to a pump drive motor through the pump drive circuit including a voltage regulator. A diode is connected between a positive output terminal of a battery charging circuit and a positive output terminal of a pump drive circuit so that a current is fed from the battery through the diode to the pump drive motor only when a voltage across the battery is higher than an output voltage of the pump drive circuit. The voltage regulator of the pump drive circuit has an adjustment value set to be higher than a maximum value of the voltage across the battery.

U.S. Pat. No. 5,681,193, which issued to Pham et al on Oct. 28, 1997, describes a dual voltage regulated supply circuit for a marine propulsion device. A marine propulsion device includes a drive unit which is adapted to be mounted on a boat and which includes a propeller shaft, an internal combustion engine being drivingly connected to the propeller shaft, and an alternator generating first and second alternating current voltages. It also includes a circuit for receiving the first and second alternating current voltages and for generating, in response to the first and second alternating current voltages, first and second direct current voltages for providing electrical power to the internal combustion engine.

U.S. patent application Ser. No. 09/847,616, which was filed on May 2, 2001, by Sleder et al and assigned to the assignee of the present application, discloses a power supply for an outboard motor. An alternator for an outboard motor engine is provided with a split stator winding that is switchable between a first state and a second state. The first state, with the switch closed, places first and second stator windings in a series aiding configuration which is intended to provide sufficient power at starting speeds. Above a preselected engine load, a switch is opened to place the first and second stator windings in a completely independent parallel association to avoid the armature reaction normally associated with circulating currents in the non-isolated windings and phase shift associated with the alternator impedance and load impedance. Otherwise, lower output power at higher operating speeds would be experienced due to the reactance of the alternator's self-inductance.

The patents described above are hereby expressly incorporated by reference in the description of the present invention.

Many different types of outboard motor starting systems are well known to those skilled in the art, including manual start systems which incorporate a pull-rope. In many types of outboard motors, the rotational speed of the crankshaft initiated by an operator pulling on the starter rope is sufficient to cause self sustaining operation of the engine. However, some outboard motors have a higher electrical power requirement and the rotational speed provided by manually pulling the starter rope can therefore be insufficient to generate the electrical power from an alternator to operate the electrical load of the engine in a manner which allows the engine to begin self sustained operation. It would therefore be significantly advantageous if an outboard motor could be provided with a system that provides enough electrical power for the power consuming components of the engine during the starting procedure. This source of electrical power would make it unnecessary for the operator to manually cause the crankshaft and alternator to rotate at a speed which is sufficient to provide all of the required power from the alternator alone.

SUMMARY OF THE INVENTION

An electrical system for an outboard motor having an engine with a manual recoil starter, made in accordance with the preferred embodiment of the present invention, comprises a battery and a start switch having a manually activated condition and a deactivated condition, wherein the start switch is connected in electrical communication with the battery. The start switch can be a toggle switch or push button that is directly actuated by hand or, preferably, it can be a switch which is activated by rotation of the manual recoil starting mechanism prior to rotation of the engine's crankshaft. The manual recoil starting mechanism is caused to rotate by an operator manually pulling on a rope or cable of the recoil starter mechanism. In either case, the activated condition results from a manual operation which is either the manual pushing of a switch or the manual caused rotation of the crankshaft and manual start mechanism.

A preferred embodiment of the present invention further comprises an electric fuel pump connected in electrical communication with the start switch. The fuel pump is connected in electrical communication with a battery when the start switch is in its activated condition and is disconnected from electrical communication with the battery when the start switch is in its deactivated condition. The present invention further comprises a timer which is connected in electrical communication with a start switch. The timer is configured to cause the start switch to be in the deactivated condition if the engine is inactive for a preselected period of time. The timer can also be controlled to disconnect the fuel pump after it has primed the system if the operator has not yet pulled the starting rope or cord.

Various embodiments of the present invention can further comprise one or more ignition coils and one or more fuel injectors, wherein both of these devices are connected in electrical communication with the start switch and also connected in electrical communication with the battery when the start switch is in the deactivated position, but is disconnected from electrical communication with the battery when the start switch is in the deactivated condition. In other words, several different electrical power consuming devices can be incorporated with the engine in various embodiments of the present invention.

A preferred embodiment of the present invention further comprises a rotational position transducer (RPT) which is connected in signal communication with the timer. The rotational position transducer provides a signal to the timer which is representative of the engine being active or inactive. For example, the rotational position transducer can incorporate a variable reluctance component or a Hall effect component which provides a signal that is responsive to rotation of the crankshaft. The absence of the signal, for a preselected period of time, is therefore representative of the inoperative state of the engine.

The battery can be rechargeable and, in certain embodiments of the present invention, can be a nickel-cadmium battery. The battery used in conjunction with the present invention has a maximum capacity of 12 amperes-hours or less when the battery is fully charged. It is intended to have sufficient capacity to power the electrical system, but not be capable of powering a starter motor. The outboard motor can comprise an engine which is exclusively manually started with no electrical starter motor. The present invention can further comprise a micro-processor which is configured to perform the function of the timer and other associated functions which relate to responding to activation of the start switch and various other components. The battery used in conjunction with the present invention can be mounted on a transom bracket of the outboard motor instead of being located under the cowl.

BRIEF DESCRIPTION OF THE DRAWINGS

The present invention will be more fully and completely understood from a reading of the description of preferred embodiment in conjunction with the drawings, in which.

DESCRIPTION OF THE PREFERRED EMBODIMENT

Figure 1:
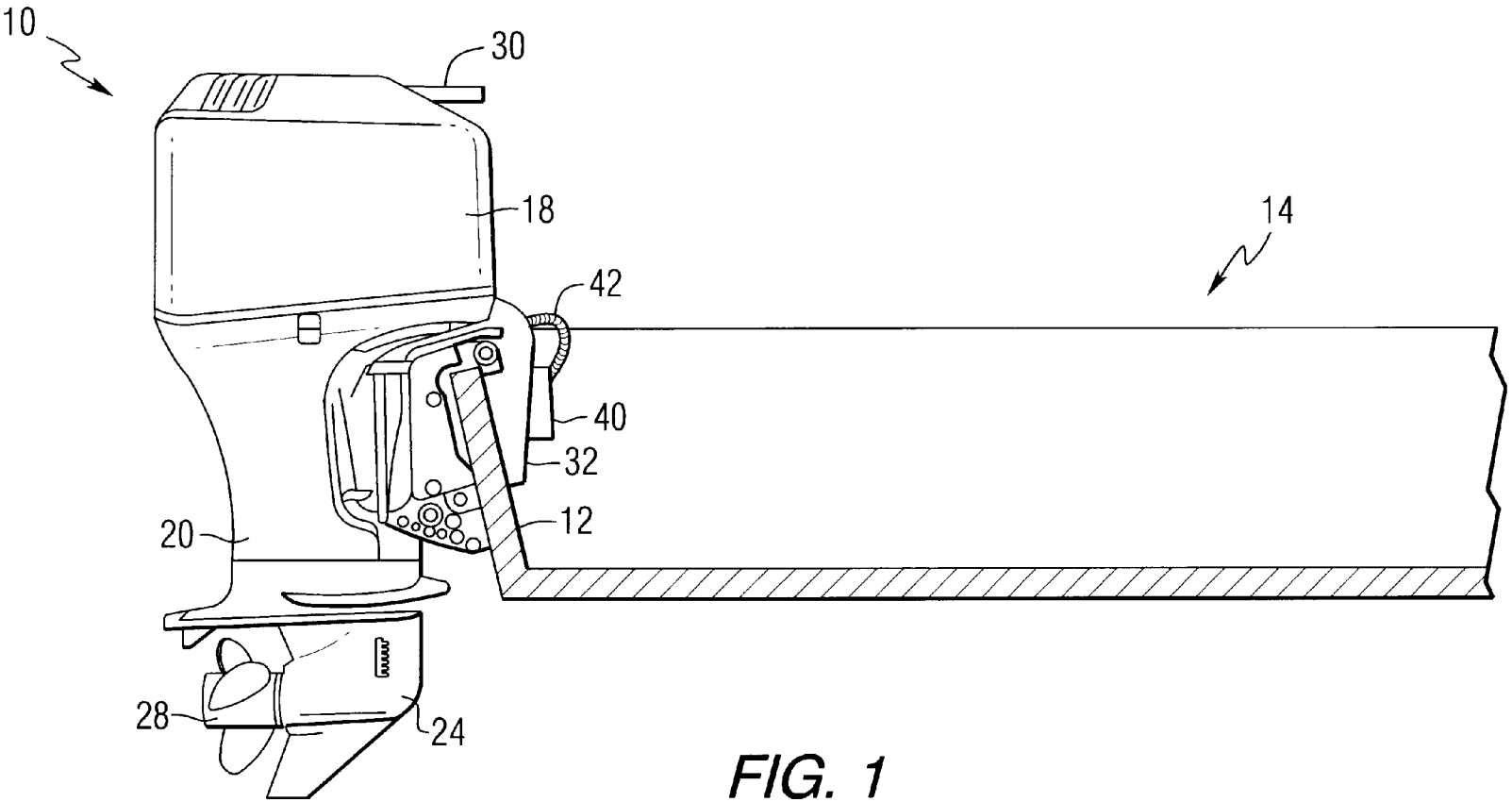
FIG. 1 shows a watercraft with an outboard motor incorporating the present invention.

Throughout the description of the preferred embodiment of the present invention, like components will be identified by like reference numerals.

As will be described in greater detail below, the present invention is intended to provide a system which allows the operator of a marine vessel to simply start a fuel injected engine by pulling a rope one time. It is not necessary, in certain embodiments, to manually operate any switches. In certain embodiments, a priming switch is manually actuated in cold start applications, but this requirement may be eliminated by using an enrichment solenoid device. It is anticipated that the free travel characteristic of a pull rope, prior to physical engagement of a toothed member to drive the crankshaft, will allow enough time for the fuel pump to be primed in response to a switch that is either manually actuated or actuated by the initial movement of the pull rope prior to rotation of the crankshaft. This switch could be a magnetic reed switch or a Hall effect device. It is further anticipated that an alternator will have two windings. These will provide a battery charging function and an accessory powering function.

FIG. 1 shows an outboard motor 10 mounted to the transom 12 of a watercraft 14. The outboard motor comprises an engine located under the cowl 18, a driveshaft housing 20 and a gearcase 24. A propeller 28 is attached to a propeller shaft which is supported within the gearcase 24 and connected in torque transmitting relation with a driveshaft vertically supported within the driveshaft housing 20. A manual start outboard motor comprises a handle 30 which is connected to a rope or cord that is associated with a manual recoil starter located under the cowl 18. The outboard motor 10 is attached to the transom 12 by a transom bracket 32. The embodiment of the present invention illustrated in FIG. 1 comprises a battery pack 40 attached to the transom bracket 32 and connected in electrical communication by an electrical conductor 42, such as an electrical cable, to components located under the cowl 18, of the outboard motor 10.

Figure 2:
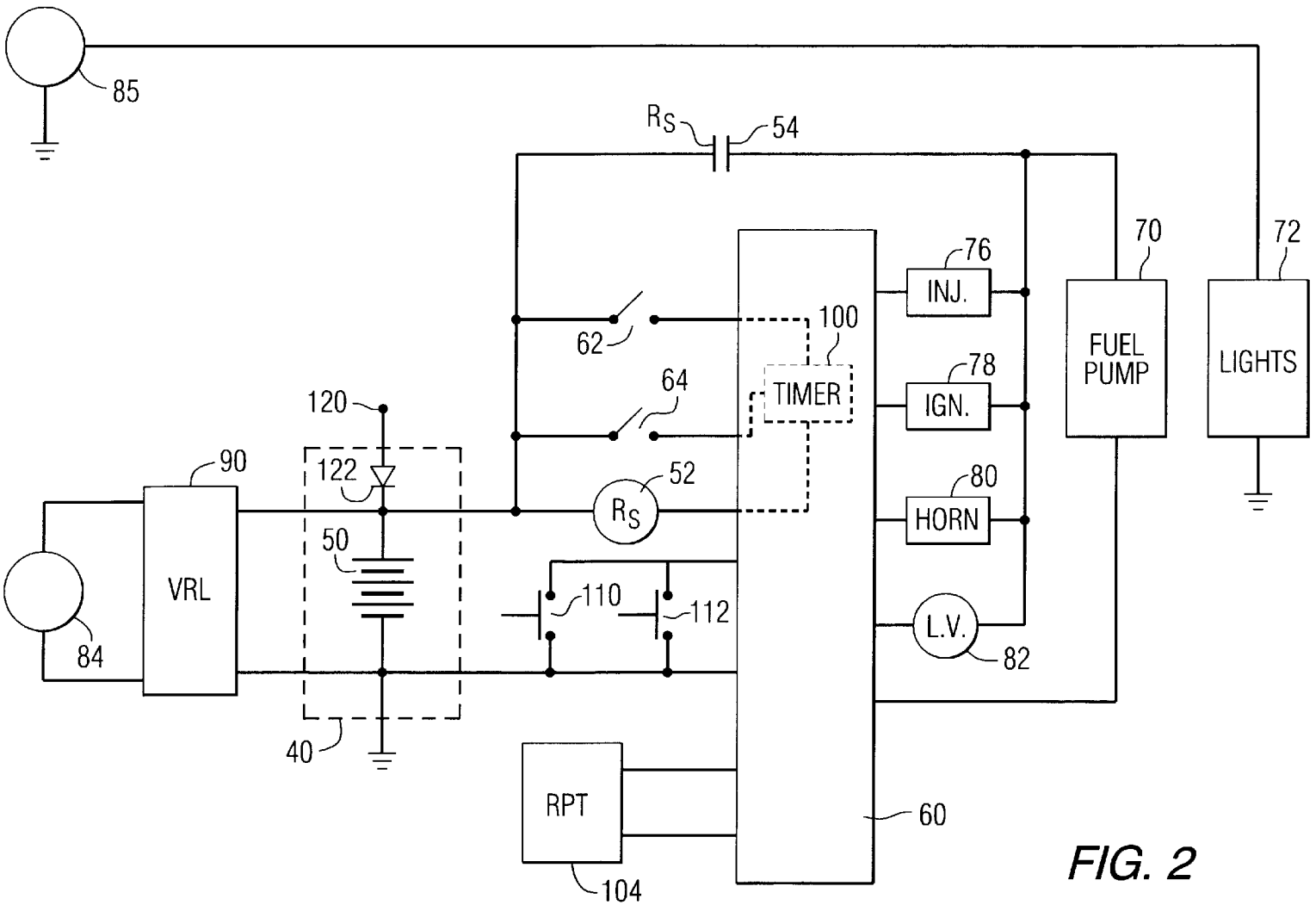
FIG. 2 is a simplified electric circuit showing the present invention.

FIG. 2 shows an electric circuit which embodies the principles of the present invention. A battery 50 is connected in electrical communication with a coil 52 of a relay which controls the operation of a pair of contacts 54. The battery 50 provides power to the coil 52 when the coil 52 of the relay is connected to a circuit point of ground potential. A microprocessor, such as the engine control module (ECM) 60 is provided with a start switch 62 which, when closed, provides a signal to the engine control module 60 which causes the engine control module to connect the coil 52 to a point of ground potential for the purpose of closing contacts 54. Switch 62 can be a manually operated switch, such as a momentary toggle switch or a non-latching push button. When the engine control module 60 receives a signal from switch 62, it actuates coil 52 and begins a timer operation. In the embodiment shown in FIG. 2, an additional start switch 64 is also provided. In certain embodiments of the present invention, a manual start switch 62 and an alternate start switch 64 can be employed. One of these two switches can be the push button or toggle switch which is manually actuated, as described above, and the other can be a switch which is actuated directly by rotation of a crankshaft of the engine. It should be understood that all alternative applications of one or more manually actuated start switches are within the scope of the present invention. In one embodiment of the present invention, a switch is operated by the initial movement of the recoil start mechanism prior to the actual rotation of the crankshaft. This switch is intended to initiate the priming of the fuel pump before the crankshaft turns sufficiently to start the engine.

The circuit in FIG. 2 comprises an electric fuel pump 70, electrical running lights 72, a plurality of fuel injectors 76, an ignition coil 78, and a horn 80. Also shown in FIG. 2 is a low voltage warning light 82.

When the contacts 54 of the start relay are closed, battery power is provided by the battery 50 to the fuel pump 70, running lights 72, fuel injectors 76, ignition coil 78, and, when desired, the horn 80 and the low voltage warning light 82, as initiated by the ECM through low side drivers. When power is provided by the battery 50 to the fuel pump 70, the injector 76, and the ignition coil 78, the engine is able to start when the operator pulls the rope of the recoil starter. Since the battery 50 is providing this electrical power during the starting procedure, the alternator 84 is not required to provide all of the electrical power for these components. It should be understood that the battery 50 is intended to have a capacity of 12 ampere-hours or less when fully charged. Therefore, the battery 50 does not have sufficient power to operate a starter motor for the purpose of starting the engine. Manual activation of the recoil starter is necessary for this purpose.

A voltage regulator and limitor (VRL) 90 is provided so that self sustaining electrical power can be provided when the engine is running. The alternator 84 produces alternating current electrical power which is received by the voltage regulator and limitor 90. As is well known and understood by those skilled in the art, the voltage regulator and limitor comprises a rectifier and a voltage regulator in order to convert AC electrical power to DC electrical power of a regulated voltage magnitude. This power is provided to the battery 50 for the purpose of recharging the battery and providing continuing power to the associated components after the engine has achieved self sustaining operation. In certain embodiments of the present invention, a separate alternator winding 85 is used to provide power for boat lights and certain other accessories as needed.

With continued reference to FIG. 2, the engine control module 60 operates a timer 100 which begins timing a period of elapsed time upon the initial signal received from the start switch. In certain embodiments of the present invention, two timing functions are performed by the ECM. One time period is used to provide power to the fuel pump for a first preselected period of only a few seconds to allow the fuel pump to prime the system. A second time period is used to maintain the electrical connections described above for a longer period, such as approximately a minute. If a rotor position transducer 104 does not provide a signal to the engine control module 60 that the crankshaft is turning and the engine has achieved self sustaining operation within a preselected period of elapsed time, the engine control module 60 will deactivate the coil 52 of the relay so that contacts 54 are placed in a deactivated condition. This prevents the battery 50 from being drained as a result of the leakage associated with the continual connection to the fuel pump 70, the running lights 72, the injector 76, the ignition coil 78, and any other electrical components connected to the system when the system is in the off state. It is anticipated that the allowed time between the initial receipt of a signal from the start switch 62 to the deactivation of contacts 54 is approximately one minute or less. In that time, the operator of the watercraft will have sufficient opportunity to pull the rope of the manual recoil starter and start the engine. Switch 110 is a stop switch that allows the operator to stop the operation of the engine and switch 112 is a lanyard switch or "dead man" switch which also stops the operation of the engine.

With continued reference to FIG. 2, connection point 120 is a circuit point which allows the operator of the watercraft to connect the battery 50 to a charging circuit which can be a device external to the circuit shown in FIG. 2. In other words, a portable charger can be connected to circuit point 120 and diode 122 for the purpose of recharging battery 50 if the charge of battery 50 falls below a useful magnitude.

Figure 3:
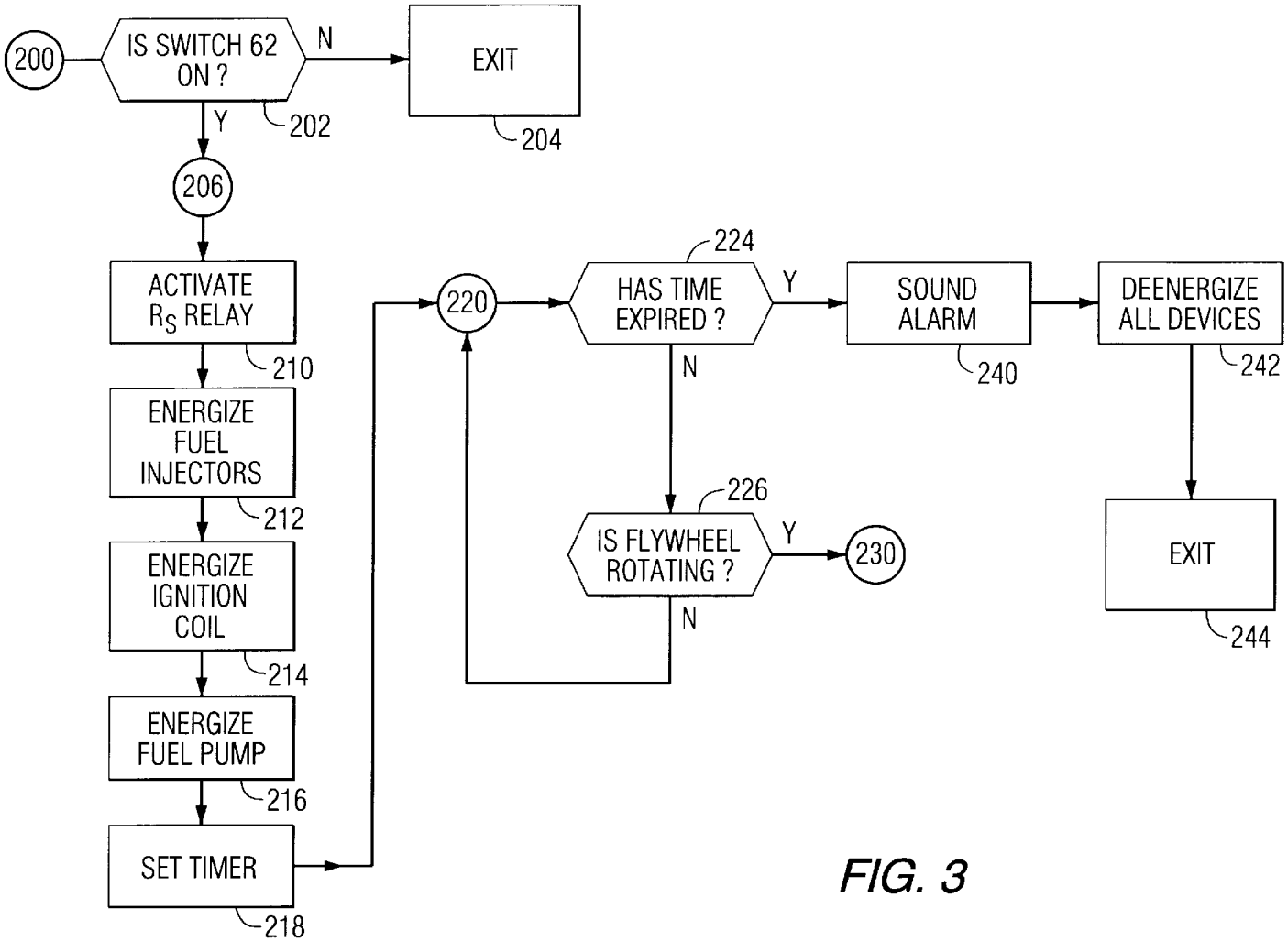
FIG. 3 is a functional block diagram showing the steps performed by an engine control module used in association with the present invention.

FIG. 3 represents a highly simplified functional block diagram of one embodiment of the present invention with regard to the steps performed by the engine control module (ECM) 60 described above. Beginning at point 200, the logic determines whether or not switch 62, or the start switch, has been activated by the operator. If it has not, the program exits as represented by functional block 204. If the decision made at functional block 202 is affirmative, the program performs the functions following point 206 in FIG. 3. It activates the coil 52 of the relay in order to close contacts 54. This is shown at functional block 210. It then energizes the fuel injectors 76, at functional block 212, by connecting the fuel injectors to a point of ground potential so that power from the battery 50 can be provided to them. The system then energizes the ignition coils 78, as shown in functional block 214, in a similar manner. As shown in functional block 216, the engine control module 60 also energizes the fuel pump 70. Simultaneous with these actions, the timer 100 is initiated at functional block 218 so that a predetermined period of time can be monitored to avoid draining the battery 50. Continuing at point 220, the engine control module 60 determines whether or not the time has expired, as shown at functional block 224. If the time has not expired, the engine control module 60 continues to monitor the rotor position transducer (RPT) 104 as shown in functional block 226. If the crankshaft is rotating, which signifies a self sustaining operation of the engine, the logic shown in FIG. 3 exits to perform other tasks. If the flywheel is not yet rotating, the program continues to point 220 to recheck the remaining allowed time provided by the timer 100. If the time expires, an alarm is sounded at functional block 240 and the horn 80 is activated. All of the electric power consuming devices are deenergized, at functional block 242, and the program exits at functional block 244.

It should be understood that FIG. 3 is a highly simplified schematic representation of only one possible strategy performed by the engine control module 60. Other control strategies are also within the scope of the presented invention.

With reference to FIGS. 1–3, it should be understood that the manual start outboard does not have a battery source available to it for providing power to a starter motor and the other components necessary for operating the engine. Known outboard motors which have exclusively manual starting engines are typically carbureted engines. Electronic fuel injection (EFI) provides superior performance and lower exhaust emissions than carbureted engines. However, electronic fuel injection requires an external battery source in order to initialize the engine control module and provide power to an electric fuel pump. If manually started engines are not provided with a battery, as is the normal arrangement, the electronic fuel injection system does not have power to operate during the starting process.

Some known systems, used on snowmobiles, provide electronic fuel injection technology that does not require any battery source. This type of system typically uses a large electrolytic capacitor to store electrical energy from an initial pool of a manual start rope. During a second pull of the same rope, this stored energy is used for initially providing power to the engine control module and the fuel pump. The present invention, on the other hand, provides a small battery, with a capacity which is less than or equal to 12 ampere-hours when fully charged, for the purpose of initializing the components of the engine requiring electrical power prior to starting. The energy from this relatively small battery is used to initialize the electronic fuel injection system, but is not used to power an electric starter motor. The engine on which the present invention is used does not have an electric starter motor. The operator is required to pull the rope of the manual recoil starter in engines incorporated in the present invention. When the present invention is used, the first pull on the manual start rope starts the engine because the small capacity battery is providing the minimal required electric power when the rope is pulled for the first time by the operator.

To start an engine which incorporates the present invention, the operator of the watercraft simply pulls the starting rope, in a preferred embodiment of the present invention, and this action is sensed by the RPT 104 which causes the ECM to activate switch 62. Battery voltage, from battery 50 is provided to the engine control module (ECM) 60, as shown in FIG. 2, and the engine control module 60 receives the signal from the start switch 62. In response to this signal, the engine control module 60 activates the coil 52 of a relay which causes contacts 54 to be closed. This connects the battery 50 to the fuel pump 70, the fuel injectors 76, and the ignition coil 78. In a preferred embodiment, between the time that the operator pulls the rope and the crankshaft rotates, the fuel system has already been primed by the fuel pump 70 which had been activated when the operator first began to move the rope. This allows the engine to start on the first pull of the rope of the manual recoil starter. If the engine control module 60 does not receive a signal from the rotor position transducer 104 within a preselected period of time, this is interpreted by the engine control module 60 as an indication that the engine has not properly achieved self sustaining operation. In response, the coil 52 of the relay is deenergized by the engine control module 60, disconnecting the battery 50 from the load which incorporates the fuel pump 70, the injectors 76, and the ignition coil 78. In certain applications, a second switch 64 can be used in conjunction with the start switch 62. The second switch 64 could be activated automatically when the user operates the recoil starter mechanism. This could be actuated by a cam on the starter mechanism or, alternatively, by a Hall effect or magnetic read switch that is operated by a magnet on the mechanism which provides a signal when the crankshaft is rotated by the operator of the watercraft pulling on the rope of the manual recoil starter. The two switches, 62 and 64, can be operated in cooperation with each other or the preferred automatically activated switch 64 can be used without switch 62 since a signal received from switch 64 would indicate that the operator has pulled the rope of the manual recoil starter and therefore wished to start the engine. These combinations are available in various embodiments of the present invention.

When the engine is operating in a self sustaining manner, the alternator 84 provides AC electrical power which is rectified by the voltage regulator 90 in order to recharge the battery 50. The voltage regulator and limitor 90 also regulates the battery voltage to prevent overcharging and to preserve the life of the battery. The voltage regulator and limitor 90 limits its DC electrical power output to a 35 volt maximum transient peak in the event that the battery becomes intermittent or disconnected from the load while the engine is running. This protects the equipment that is normally connected to the battery from damage due to an overvoltage from the alternator 84. During start up, and during low engine speed operation in certain applications, the system shown in FIG. 2 is powered by the battery 50. When the engine is running, the alternator 84 is the primary power source. The alternator 84 has sufficient capacity to recharge the battery 50 and to power the electrical system load. The presence of the battery 50 provides a DC electrical power source that is not dependent upon rotation of the engine and which has a low ripple content and an excellent transient response characteristic. The engine control module 60 monitors the battery voltage continually. If the voltage potential across the terminals of the battery 50 drops below a predetermined magnitude, indicating a charging system failure or battery degradation, an audible alarm or horn 80 is activated to alert the user that there is limited running time available and that the operator should return the watercraft to shore to perform maintenance on the system. The low voltage light 82 is also used to signal the operator of this condition. At this time, the ECM can revert to a power conserving mode of operation in order to permit the vessel to be piloted back to shore for maintenance.

A battery used in conjunction with the present invention should be a rechargeable battery. In one embodiment, the battery is a nickel-cadmium battery having a capacity of approximately 2.5 ampere-hours when fully charged. One embodiment of the present invention places the battery within a battery pack 40 that is represented by dashed lines in FIG. 2 and illustrated in FIG. 1 at a position within the watercraft 14. By locating the battery pack 40 at a position attached to the transom bracket 32, the battery is maintained at an ambient temperature that is considerably lower than the temperature under the cowl 18. This lower temperature extends the life of the battery 50.

In a preferred embodiment, when the operator pulls the starting rope, switch 62 is automatically actuated as a result of the movement of the portion of the recoil mechanism moved by the rope. Switch 62 initiates the response from the ECM and also energizes the relay 52. The use of the relay 52 helps to minimize the potential of leakage current which could otherwise drain the battery. The fuel pump 70 is turned on by the ECM 60 and this begins to prime the fuel system. Battery voltage is applied to the fuel injectors 76, ignition coils 78, and warning components, 80 and 82. If the ECM does not receive a signal from the RPT 104 within a preselected time period (e.g. 10–60 seconds), the relay 52 is de-energized and power is disconnected to save battery power. The time delay, at least with respect to the fuel pump 70, may be shorter (e.g. 2–3 seconds). Once the engine is operating satisfactorily, the battery charge is monitored by the ECM and the warning components are used to alert the operator of a low charge condition.

Although the present invention has been described in considerable detail and illustrated to show a specifically preferred embodiment, it should be understood that alternative embodiments are also within its scope.

What is claimed is:

1. An electrical system for an outboard motor having an engine with a manual recoil starter, comprising:

a battery;

a start switch having a manually activated condition and a deactivated condition and being connected in electrical communication with said battery;

an electric fuel pump connected in electrical communication with said start switch, said fuel pump being connected in electrical communication with said battery when said start switch is in said activated condition and being disconnected from electrical communication with said battery when said start switch is in said deactivated condition; and a timer, said timer being connected in electrical communication with said start switch, said timer being configured to cause said start switch to be in said deactivated condition if said engine is inactive for a preselected period of time.

2. The electrical system of claim 1, further comprising:

an ignition coil connected in electrical communication with said start switch, said ignition coil being connected in electrical communication with said battery when said start switch is in said activated condition and being disconnected from electrical communication with said battery when said start switch is in said deactivated condition.

3. The electrical system of claim 1, further comprising:

a fuel injector connected in electrical communication with said start switch, said fuel injector being connected in electrical communication with said battery when said start switch is in said activated condition and being disconnected from electrical communication with said battery when said start switch is in said deactivated condition.

4. The electrical system of claim 1, further comprising:

a rotational position transducer connected in signal communication with said timer, said rotational position transducer providing a signal to said timer which is representative of said engine being active or inactive.

5. The electrical system of claim 1, wherein:

said battery is rechargeable.

6. The electrical system of claim 1, further comprising:

a microprocessor, said microprocessor being configured to perform the function of said timer.

7. The electrical system of claim 1, wherein:

said battery is a nickel-cadmium battery.

8. The electrical system of claim 1, wherein:

said battery has a maximum capacity of 12 ampere-hours or less when said battery is fully charged.

9. The electrical system of claim 1, wherein:

said outboard motor comprises an exclusively manually started engine.

10. The electrical system of claim 1, wherein:

said start switch comprises a relay having an actuating coil and a pair of contacts which are responsive to the status of said coil.

11. The electrical system of claim 1, wherein:

said battery is mounted on a transom bracket of said outboard motor.

12. An electrical system for an outboard motor having an engine with a manual recoil starter, comprising:

a rechargeable battery;

a start switch having a manually activated condition and a deactivated condition and being connected in electrical communication with said battery;

a fuel injector connected in electrical communication with said start switch, said fuel injector being connected in electrical communication with said battery when said start switch is in said activated condition and being disconnected from electrical communication with said battery when said start switch is in said deactivated condition; and a timer, said timer being connected in electrical communication with said start switch, said timer being configured to cause said start switch to be in said deactivated condition if said engine is inactive for a preselected period of time.

13. The electrical system of claim 1, further comprising:

an ignition coil connected in electrical communication with said start switch, said ignition coil being connected in electrical communication with said battery when said start switch is in said activated condition and being disconnected from electrical communication with said battery when said start switch is in said deactivated condition; and an electric fuel pump connected in electrical communication with said start switch, said fuel pump being connected in electrical communication with said battery when said start switch is in said activated condition and being disconnected from electrical communication with said battery when said start switch is in said deactivated condition.

14. The electrical system of claim 13, further comprising:

a rotational position transducer connected in signal communication with said timer, said rotational position transducer providing a signal to said timer which is representative of said engine being active or inactive.

15. The electrical system of claim 14, further comprising:

a microprocessor, said microprocessor being configured to perform the function of said timer.

16. The electrical system of claim 15, wherein:

said battery is a nickel-cadmium battery having a maximum capacity of 12 ampere-hours or less when said battery is fully charged.

17. The electrical system of claim 16, wherein:

said outboard motor comprises an exclusively manually started engine and said start switch comprises a relay having an actuating coil and a pair of contacts which are responsive to the status of said coil.

18. The electrical system of claim 17, wherein:

said battery is mounted on a transom bracket of said outboard motor.

19. An electrical system for an outboard motor having an engine with a manual recoil starter, comprising:

a rechargeable battery;

a start switch having a manually activated condition and a deactivated condition and being connected in electrical communication with said battery;

an ignition coil connected in electrical communication with said start switch, said ignition coil being connected in electrical communication with said battery when said start switch is in said activated condition and being disconnected from electrical communication with said battery when said start switch is in said deactivated condition;

an electric fuel pump connected in electrical communication with said start switch, said fuel pump being connected in electrical communication with said battery when said start switch is in said activated condition and being disconnected from electrical communication with said battery when said start switch is in said deactivated condition;

a fuel injector connected in electrical communication with said start switch, said fuel injector being connected in electrical communication with said battery when said start switch is in said activated condition and being disconnected from electrical communication with said battery when said start switch is in said deactivated condition;

a timer, said timer being connected in electrical communication with said start switch, said timer being configured to cause said start switch to be in said deactivated condition if said engine is inactive for a preselected period of time a microprocessor, said microprocessor being configured to perform the function of said timer;

a rotational position transducer connected in signal communication with said timer, said rotational position transducer providing a signal to said timer which is representative of said engine being active or inactive, said outboard motor comprising an exclusively manually started engine and said start switch comprises a relay having an actuating coil and a pair of contacts which are responsive to the status of said coil.

20. The electrical system of claim 19, wherein:

said battery is a nickel-cadmium battery having a maximum capacity of 12 ampere-hours or less when said battery is fully charged.

* * * * *